US011467532B2

(12) United States Patent
Kita et al.

(10) Patent No.: US 11,467,532 B2
(45) Date of Patent: Oct. 11, 2022

(54) ACCESS RESTRICTION DEVICE FOR CONSUMABLE COMPONENT AND IMAGE FORMING APPARATUS INCLUDING THE ACCESS RESTRICTION DEVICE

(71) Applicant: RICOH COMPANY, LTD., Tokyo (JP)

(72) Inventors: Emi Kita, Kanagawa (JP); Noriaki Funamoto, Tokyo (JP); Hiroshi Okamoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/363,760

(22) Filed: Jun. 30, 2021

(65) Prior Publication Data

US 2022/0004141 A1 Jan. 6, 2022

(30) Foreign Application Priority Data

Jul. 2, 2020 (JP) ..... JP2020-114702

(51) Int. Cl.
*G03G 21/16* (2006.01)
*G03G 21/18* (2006.01)

(52) U.S. Cl.
CPC ..... *G03G 21/1676* (2013.01); *G03G 21/1633* (2013.01); *G03G 21/1647* (2013.01); *G03G 21/1821* (2013.01); *G03G 2221/1654* (2013.01)

(58) Field of Classification Search
CPC ..... G03G 21/1676; G03G 21/1633; G03G 21/1647; G03G 21/1821; G03G 2221/1654; G03G 15/0865
See application file for complete search history.

(56) References Cited

U.S. PATENT DOCUMENTS

| | | | | |
|---|---|---|---|---|
| 2014/0140727 | A1* | 5/2014 | Shimoi | G03G 21/1633 399/121 |
| 2014/0248060 | A1 | 9/2014 | Oshikawa et al. | |
| 2018/0052419 | A1* | 2/2018 | Maeda | G03G 21/1633 |
| 2019/0179237 | A1 | 6/2019 | Kita et al. | |
| 2019/0302676 | A1* | 10/2019 | Saeki | G03G 21/1633 |
| 2020/0310336 | A1* | 10/2020 | Gamo | G03G 21/1633 |

FOREIGN PATENT DOCUMENTS

| | | |
|---|---|---|
| JP | 2007-322678 | 12/2007 |
| JP | 2010-107552 | 5/2010 |
| JP | 2014-025991 | 2/2014 |
| JP | 2017-198857 | 11/2017 |

* cited by examiner

*Primary Examiner* — Sandra Brase
(74) *Attorney, Agent, or Firm* — Xsensus LLP

(57) ABSTRACT

An access restriction device for a consumable component of an apparatus body includes an access restriction cover is rotatably attached to a side surface of the apparatus body; a lock mechanism to lock and unlock opening of the cover; the cover openable in an unlocked state of the lock mechanism; a hinge portion disposed at a lower position in a direction of gravity and a position closer to the apparatus body in a horizontal direction than a center of gravity of the cover in a closed state of the cover, the cover being rotatably coupled to the apparatus body via the hinge portion; and an engaged portion disposed at a position higher in the direction of gravity than the center of gravity of the cover in the closed state. The cover is engaged with an engaging portion of the lock mechanism via the engaged portion.

14 Claims, 11 Drawing Sheets

ACCESS RESTRICTION DEVICE FOR CONSUMABLE COMPONENT AND IMAGE FORMING APPARATUS INCLUDING THE ACCESS RESTRICTION DEVICE

CROSS-REFERENCE TO RELATED APPLICATION

This patent application is based on and claims priority pursuant to 35 U.S.C. § 119(a) to Japanese Patent Application No. 2020-114702, filed on Jul. 2, 2020, in the Japan Patent Office, the entire disclosure of which is hereby incorporated by reference herein.

BACKGROUND

Technical Field

Embodiments of the present disclosure relate to an access restriction device for a consumable component that enables or disables access to the consumable component when the consumable component of an apparatus body of, for example, an image forming apparatus is attached and detached for replacement, and an image forming apparatus including the access restriction device.

Related Art

In an image forming apparatus, a toner bottle containing toner as a developer is detachably mounted. When the remaining amount of the toner in the toner bottle decreases a prescribed amount (toner end amount) or less, the fact that the replacement time of the toner bottle has come is displayed on an operation panel of the image forming apparatus. Since toner bottles of a plurality of colors are used in the color image forming apparatus, the replacement time of a toner bottle is also displayed for each color on the operation panel.

To prevent erroneous replacement of the toner bottle before the toner end, for example, a lock cover may be disposed at a toner bottle entrance to prevent access to the toner bottle. When the toner bottle is replaced and the lock cover is closed, an engaged portion of the lock cover is engaged with an engaging portion of a body-side lock mechanism, and the opening of the lock cover is locked until the next toner end is reached.

SUMMARY

In an aspect of the present disclosure, there is provided an access restriction device for a consumable component of an apparatus body. The access restriction device includes an access restriction cover, a lock mechanism, a hinge portion, and an engaged portion. The access restriction cover is rotatably attached to a side surface of the apparatus body. The lock mechanism locks and unlocks opening of the access restriction cover. The access restriction cover is openable in an unlocked state of the lock mechanism. The hinge portion is disposed at a lower position in a direction of gravity and a position closer to the apparatus body in a horizontal direction than a center of gravity of the access restriction cover in a closed state of the access restriction cover. The access restriction cover is rotatably coupled to the apparatus body via the hinge portion. The engaged portion is disposed at a position higher in the direction of gravity than the center of gravity of the access restriction cover in the closed state of the access restriction cover. The access restriction cover is engaged with an engaging portion of the lock mechanism via the engaged portion.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1A:
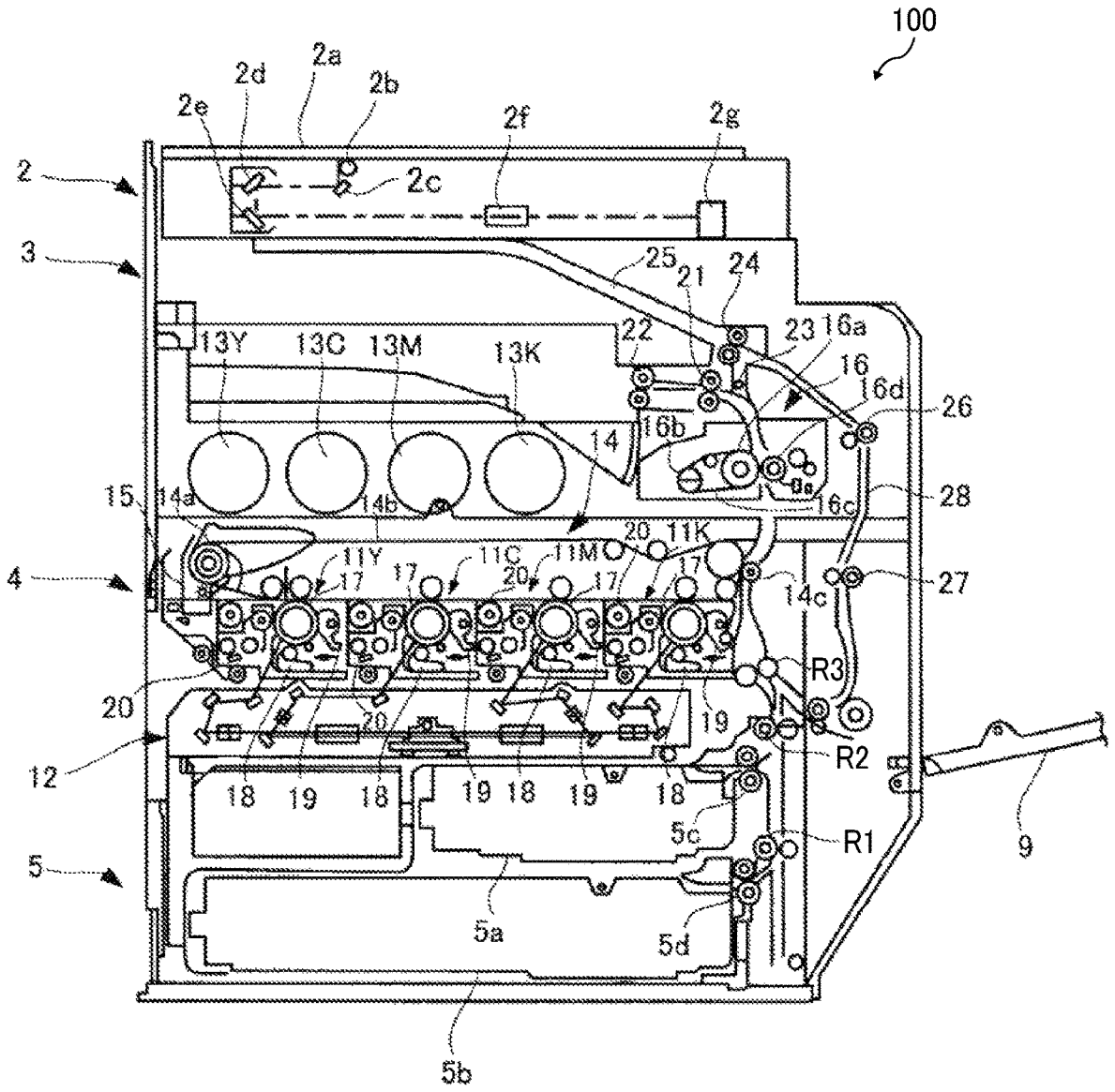
FIG. 1A is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, descriptions are given of an electrophotographic printer (hereinafter referred to as a printer) 100 as an image forming apparatus and an access restriction device for a consumable component (toner bottle) according to embodiments of the present disclosure.

In FIG. 1A, a printer 100 is a tandem-type full-color image forming apparatus. The printer 100 includes a scanner unit 2 as an image reading unit, an operation unit 6, a sheet ejection unit 3, an image forming unit 4 disposed below the sheet ejection unit 3, and a sheet feed unit 5. The operation unit 6 (see FIG. 1B) is disposed on the front side of the scanner unit 2. The sheet ejection unit 3 is disposed below the scanner unit 2. The image forming unit 4 is disposed below the sheet ejection unit 3. The sheet feed unit 5 serves as a two-stage sheet feed unit disposed below the image forming unit 4.

The scanner unit 2 includes an exposure glass 2*a*, a light source 2*b*, a first mirror member 2*c*, a second mirror member 2*d*, a third mirror member 2*e*, an imaging lens 2*f*, and an image sensor 2*g* such as a charge-coupled device (CCD). The light source 2*b* and the first mirror member 2*c* are held by a first traveling body. The second mirror member 2*d* and the third mirror member 2*e* are held by a second traveling body.

The scanner unit 2 irradiates a document placed on the exposure glass 2*a* with light from the light source 2*b*. Reflection light from the document is turned back by the mirror members 2*c*, 2*d*, and 2*e*, and the reflection light is imaged by the imaging lens 2*f* and read by the image sensor 2*g*.

For example, a platen that presses a document placed on the exposure glass 2*a*, an automatic document feeder (ADF) that automatically conveys a document onto the exposure glass 2*a* and realizes document reading by a sheet-through method are provided above the scanner unit 2.

The image forming unit 4 includes four process cartridges 11Y, 11C, 11M, and 11K (hereinafter also simply referred to as process cartridges 11) arranged in parallel in a body serving as an apparatus body of an image forming apparatus and an optical writing device 12 as an optical writing unit. The optical writing device 12 is disposed below the four process cartridges 11.

Each process cartridge 11 has the same configuration and includes a photoconductive drum 17, a charging device 18, a cleaning device 19, and a developing device 20. The process cartridges 11 form images of respective colors of yellow, cyan, magenta, and black.

The image forming unit 4 includes four toner bottles 13Y, 13C, 13M, and 13K (hereinafter also simply referred to as toner bottles 13) containing toners of different colors (yellow, cyan, magenta, and black), an intermediate transfer device 14, an intermediate transfer cleaning device 15, and a fixing device 16. The four toner bottles 13 are arranged side by side in the horizontal direction, and are configured so that the toner bottles 13 are attachable and detachable and are replaceable by opening an outer cover 80 and an access restriction cover 30 when a bottle replacement time comes as described later.

The toner bottles 13 have the same configuration and are disposed below the sheet ejection unit 3. Each toner bottle 13 is filled with toner of each color of yellow, cyan, magenta, and black. Each toner bottle 13 is configured to supply the filled toner of each color to the process cartridge 11 corresponding to each color via a supply path.

The optical writing device 12 includes, for example, four laser-diode-type light sources corresponding to the respective colors, an optical system that collimates laser beams emitted from the light sources, one deflector including a polygon mirror and a polygon motor, and an optical system including a lens for scanning and imaging such as an fθ lens, a lens for correction, and a mirror disposed on an optical path of each light source.

The optical writing device 12 distributes laser beams emitted from four light sources to four systems by one deflector according to image data of the respective colors to perform polarization scanning. The surfaces of the photoconductive drums 17 of the respective colors charged by the charging devices 18 are irradiated with the laser beams for polarization scanning, so that electrostatic latent images are written on the four photoconductive drums 17.

The intermediate transfer device 14 is disposed above the process cartridges 11 and includes a primary transfer roller 14*a*, an intermediate transfer belt 14*b*, and a secondary transfer roller 14*c*. The intermediate transfer device 14 applies a predetermined transfer voltage to the primary transfer roller 14*a* to primarily transfer the toner images formed on the photoconductive drums 17 onto the rotating intermediate transfer belt 14*b*.

When a predetermined transfer voltage is applied to the secondary transfer roller 14*c*, the toner images transferred onto the intermediate transfer belt 14*b* is secondarily transferred onto a recording sheet. The intermediate transfer cleaning device 15 is disposed on the left side of the intermediate transfer device 14 in FIG. 1A and removes residual toner on the intermediate transfer belt 14*b* after the transfer of the toner images to the recording sheet.

The fixing device 16 is disposed on the upper right side of the intermediate transfer device 14 and on the right side of the toner bottles 13 in FIG. 1A. The fixing device 16 includes a fixing roller 16*a*, a heating roller 16*b*, a fixing belt 16*c* supported by the fixing roller 16*a* and the heating roller 16*b*, and a pressing roller 16*d* in contact with the fixing belt 16*c* with a predetermined pressing force. The fixing device 16 fixes the toner images, which have been transferred to the recording sheet, on the recording sheet by heat and pressure.

A conveying roller 21 and a sheet ejection roller 22 are disposed above the fixing device 16 and convey and eject the recording sheet toward the sheet ejection unit 3. A switching claw 23 that switches the conveyance path in duplex copying, a reverse conveying roller 24 and a reverse conveyance path 25 that reverse the direction of the recording sheet in a switchback manner are disposed above the fixing device 16.

In FIG. 1A, a duplex conveyance path 28 is disposed on the right side of the fixing device 16. A first duplex conveying roller 26 and a second duplex conveying roller 27 are disposed on the duplex conveyance path 28. For the duplex conveyance path 28 and the first duplex conveying roller 26 and the second duplex conveying roller 27, the recording sheet, which has temporarily been stacked on the reverse conveyance path 25, is reversed by the reverse conveying roller 24 and conveyed on the duplex conveyance path 28 by the conveying rollers 26 and 27. The reversed recording sheet is re-fed to a registration roller described later.

The image forming unit 4 emits light from the optical writing device 12 onto the photoconductive drums 17 charged by the charging devices 18 to write latent images. The developing devices 20 supply toner to the surfaces of the photoconductive drums 17, on which the latent images have been written, to visualize the latent images as toner images. The visualized toner images are transferred to a recording sheet by the intermediate transfer device 14, and the transferred images are fixed to the recording sheet by the fixing device 16 to form an image.

The sheet feeding unit 5 includes two stages of a first sheet feeding cassette 5*a* and a second sheet feeding cassette 5*b* in which recording sheets are stored, and a first sheet feeding device 5*c* and a second sheet feeding device 5*d*. A first conveying roller R1 and a second conveying roller R2 are disposed downstream from the second sheet feeding device 5*d* and the first sheet feeding device 5*c* in a sheet feeding direction. A registration roller R3 is disposed downstream from the first conveying roller R1 and the second conveying roller R2 in the sheet feeding direction and before the secondary transfer roller 14*c*.

The sheet feeding unit 5 feeds a recording sheet from one of the first sheet feeding cassette 5*a* and the second sheet feeding cassette 5*b* by the first sheet feeding device 5*c* or the second sheet feeding device 5*d*, and feeds the recording sheet toward the registration roller R3 via the first conveying roller R1 and the second conveying roller R2. The registration roller R3 is configured to feed the recording sheet fed via the first conveying roller R1 and the second conveying roller R2 to the secondary transfer roller 14*c* at a predetermined timing.

Figure 1B:
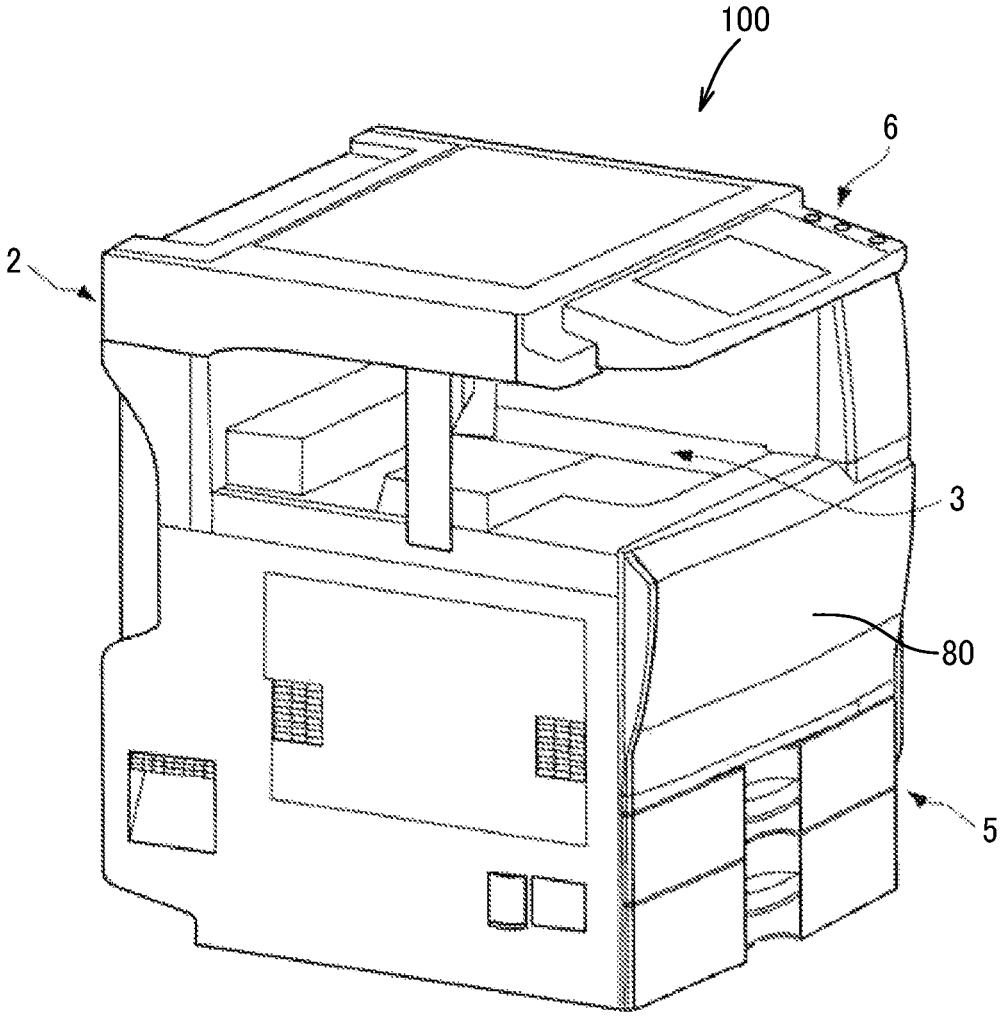
FIG. 1B is an external perspective view of the image forming apparatus of FIG. 1A.
Figure 1C:
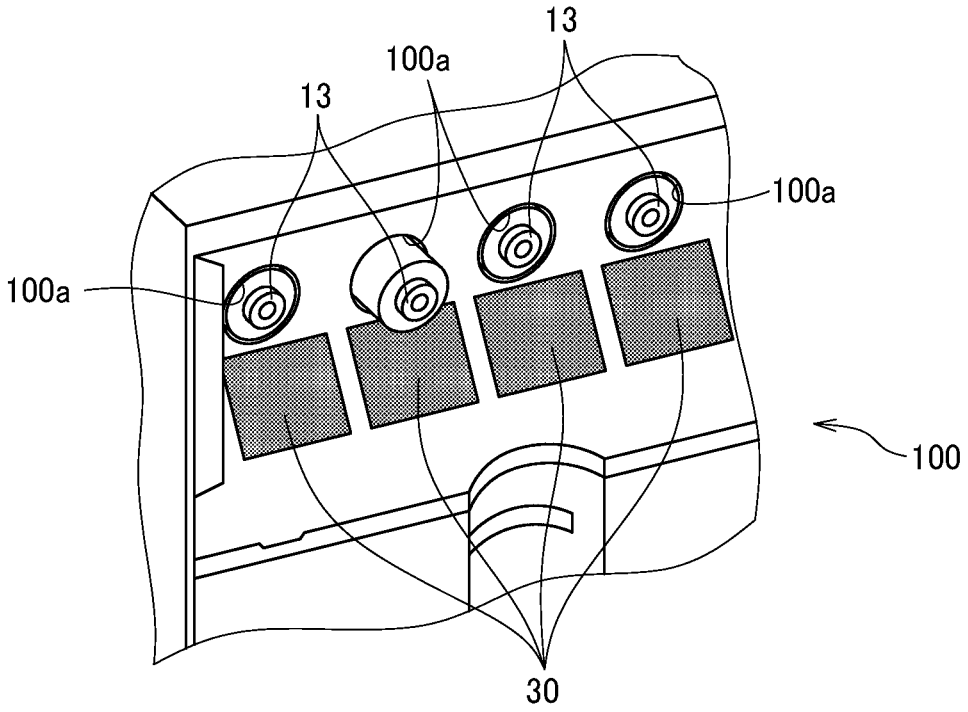
FIG. 1C is a perspective view of a toner bottle entrance with an access restriction cover opened, according to an embodiment of the present disclosure.

As illustrated in FIG. 1B, the operation unit 6 disposed on the front side of the scanner unit 2 in an upper portion of the body of the printer 100 includes various input keys for operating various functions of the printer 100 including, for example, a start key, a ten key pad, a function setting key, a reset key, and a clear-and-stop key, and a display unit that displays various input information and the state of the printer 100. An outer cover 80 is attached to a side surface of the body of the printer 100. The outer cover 80 is opened as illustrated in FIG. 1C. The toner bottle 13 is replaced as described later, and maintenance of the image forming unit 4 is performed.

Access Restriction Cover and Lock Mechanism

Figure 2A:
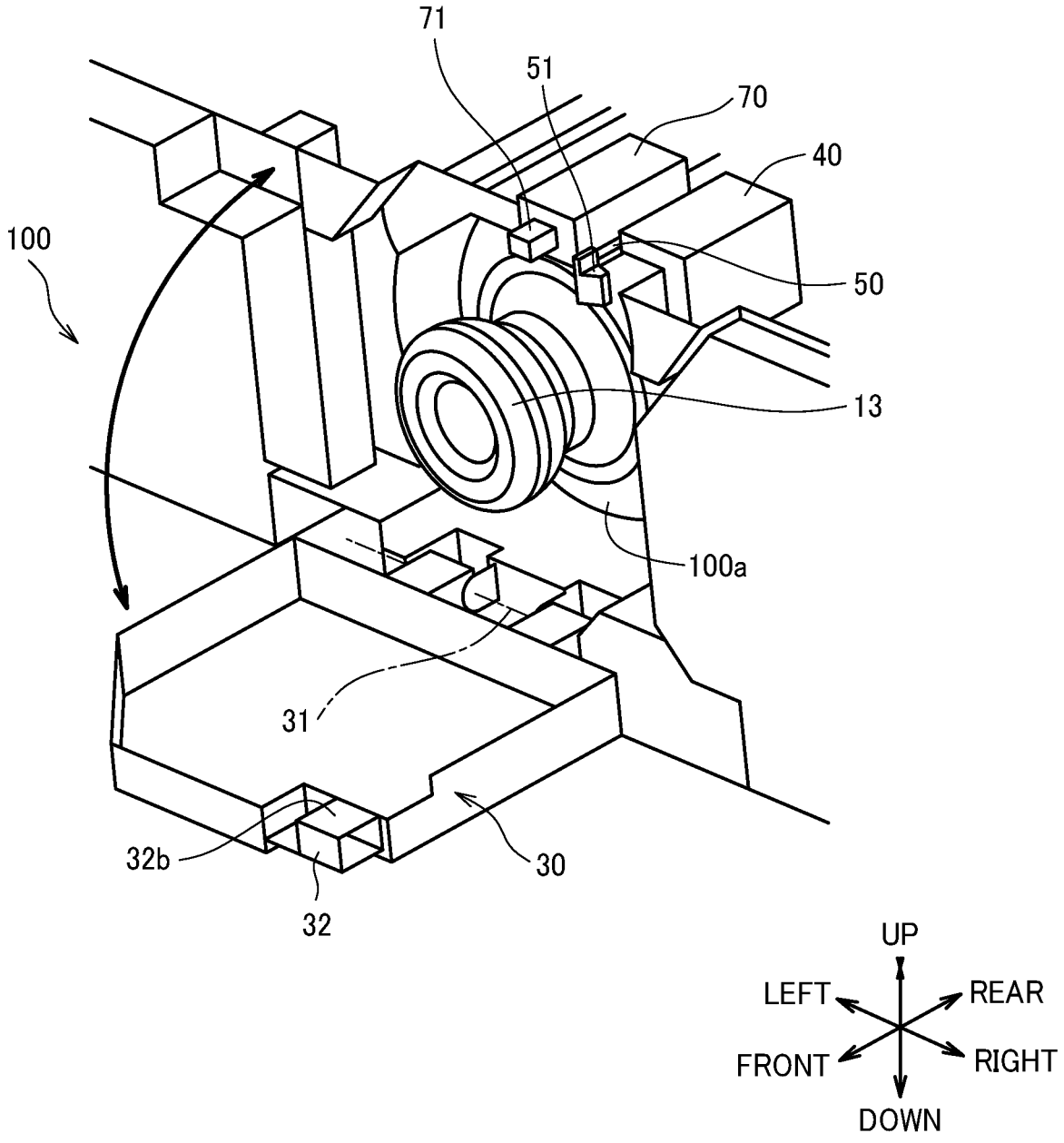
FIG. 2A is a perspective view of a toner bottle entrance with an access restriction cover opened, according to an embodiment of the present disclosure.

FIG. 2A illustrates the access restriction cover 30 attached to the toner bottle entrance 100*a* of the body of the printer 100. The access restriction cover 30 is vertically rotatable about a hinge portion 31 disposed at a lower portion of the toner bottle entrance 100*a*. The access restriction cover 30 is configured to stop substantially horizontally at a predetermined position by a stopper (stop mechanism) on the body side when the access restriction cover 30 rotates outward and downward by its own weight.

An engaged portion 32 having a shape of a laterally long rectangular tube is formed at an upper end portion (distal end portion) of the access restriction cover 30 opposite to the hinge portion 31. A solenoid 40 and a lock lever 50 constituting a lock mechanism of the access restriction cover 30 are disposed above the toner bottle entrance 100*a*. When the engaged portion 32 of the access restriction cover 30 is engaged with an engaging portion 51 of the lock lever 50, the opening of the access restriction cover 30 is locked.

Figure 3A:
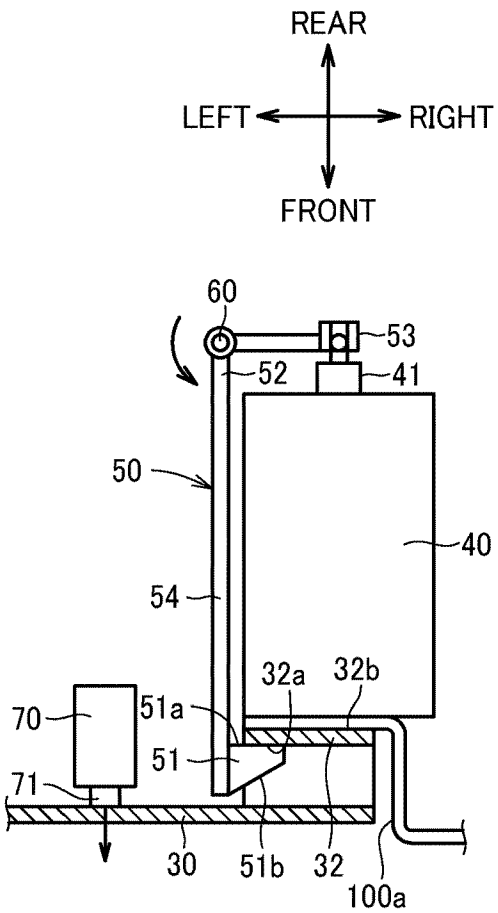
FIG. 3A is a plan view of a lock mechanism in a locked state.
Figure 3B:
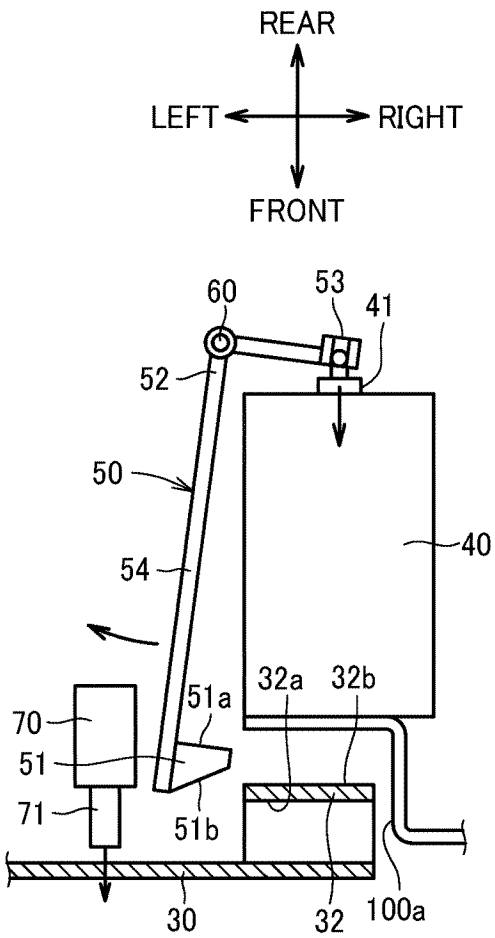
FIG. 3B is a plan view of the lock mechanism in an unlocked state.
Figure 3C:
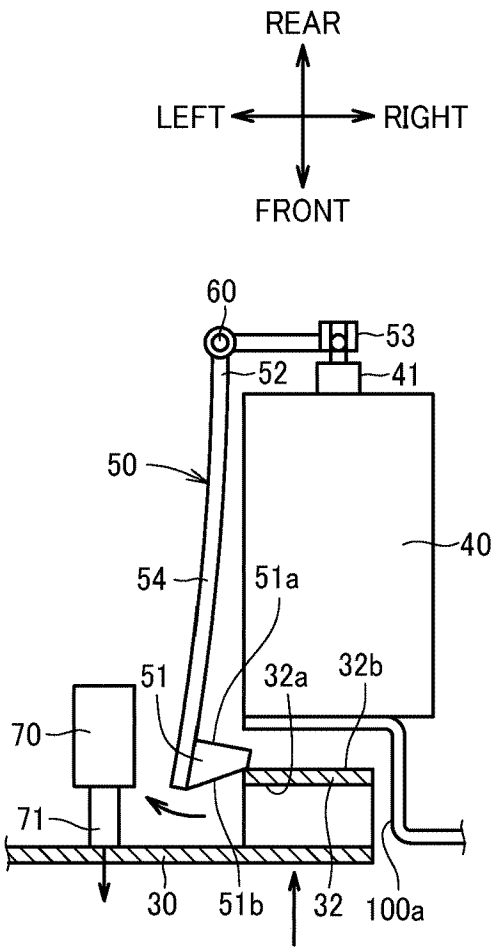
FIG. 3C is a plan view of the lock mechanism in a state immediately before locking.

As illustrated in FIGS. 3A to 3C, the lock lever 50 has a rotating portion 52 having an L-shape in plan view at a rear base end portion of the lock lever 50. The rotating portion 52 is rotatably supported by a vertical support shaft 60 fixed to the body of the printer 100. A torsion spring is mounted around the support shaft 60, and a counterclockwise turning moment is applied to the lock lever 50 in FIG. 3A by the biasing force of the torsion spring.

A short input end 53 extends from the rotating portion 52 of the lock lever 50 toward a plunger 41 behind the solenoid 40. The input end 53 is connected to a distal end portion of the plunger 41. The lock lever 50 rotates (swings) about the support shaft 60 by the forward and backward movement of the plunger 41.

The plunger 41 of the solenoid 40 is in a state of projecting rearward as illustrated in FIG. 3A normally (when the energization is OFF), and the input end 53 of the lock lever 50 is rotated rearward. An elastic arm portion 54 extending from the rotating portion 52 of the lock lever 50 toward the toner bottle entrance 100*a* normally moves to the right side when the toner bottle entrance 100*a* is viewed from the front.

The above-described engaging portion 51 is formed at a distal end portion of the elastic arm portion 54 of the lock lever 50. As illustrated in FIG. 3A, the engaging portion 51 is of a substantially triangular shape in plan view and has an engaging side 51*a* perpendicular to a longitudinal direction of the elastic arm portion 54 and an inclined tapered side 51*b*. As illustrated in FIG. 3A, the engaging side 51*a* is engaged with an inner surface 32*a* of the rectangular cylindrical engaged portion 32 of the access restriction cover 30. Thus, the access restriction cover 30 is locked.

When the access restriction cover 30 is closed, the outer surface 32*b* of the rectangular cylindrical engaged portion 32 presses the tapered side 51*b* of the engaging portion 51 at the distal end of the elastic arm portion 54. Accordingly, the elastic arm portion 54 is elastically deformed leftward as illustrated in FIG. 3C. When the outer surface 32*b* of the engaged portion 32 further presses the tapered side 51*b*, the engaging side 51*a* of the engaging portion 51 is snap-fitted to the inner surface 32*a* of the engaged portion 32 by the restoring force of the elastic arm portion 54 as soon as the outer surface 32*b* rides over the tapered side 51*b*.

Variation of Engaging Portion and Engaged Portion

Figure 3D:
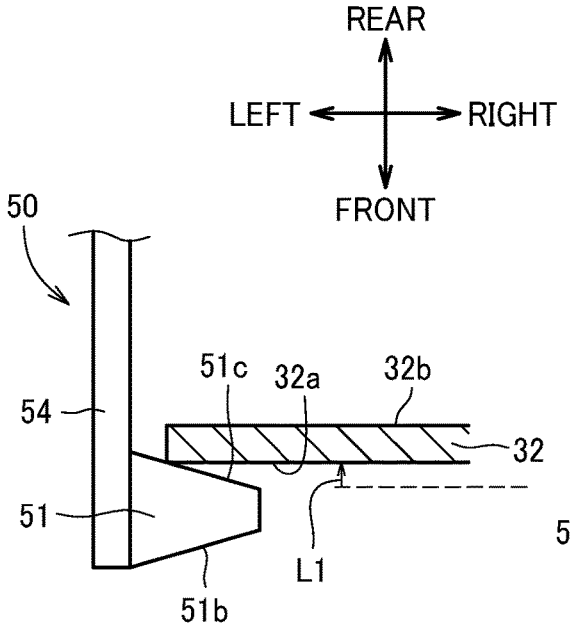
FIG. 3D is a plan view of a lock mechanism according to a first variation in a locked state.
Figure 3E:
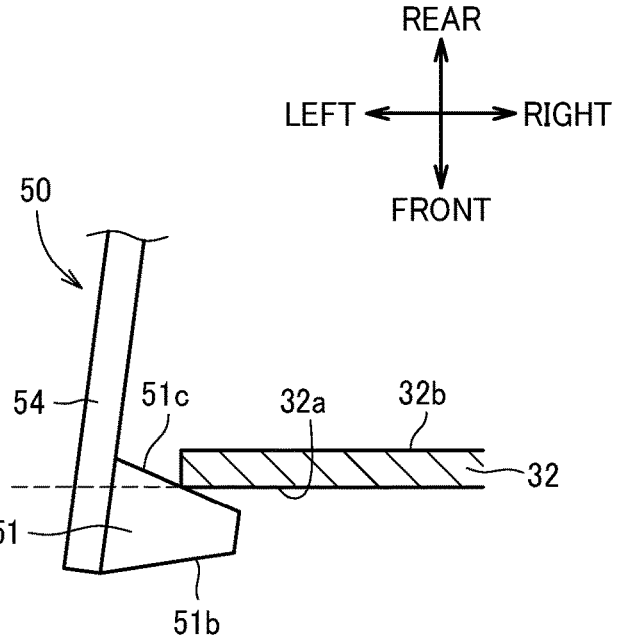
FIG. 3E is a plan view of the lock mechanism of FIG. 3D in a state immediately before locking.

The engaging side 51*a* of the engaging portion 51 is perpendicular to the longitudinal direction of the elastic arm portion 54 in FIGS. 3A to 3C. However, as illustrated in a first variation in FIGS. 3D and 3E, a tapered engaging side 51*c* may be configured to obliquely engage with the inner surface 32*a* of the engaged portion 32. With such a tapered engaging side 51*c*, the engaged portion 32 or the access restriction cover 30 can be pulled toward the body side by the tapered action by the distance L1 while the state shifts from the state immediately before engagement illustrated in FIG. 3E to the engagement completion state illustrated in FIG. 3D.

If there is a gap between the body of the printer 100 and the access restriction cover 30, the access restriction cover 30 may vibrate due to vibration during operation of the printer 100, which might cause abnormal noise (chattering noise). Drawing the access restriction cover 30 toward the body of the printer 100 by the distance L1, the clearance can be reduced to prevent the occurrence of abnormal noise.

Figure 3F:
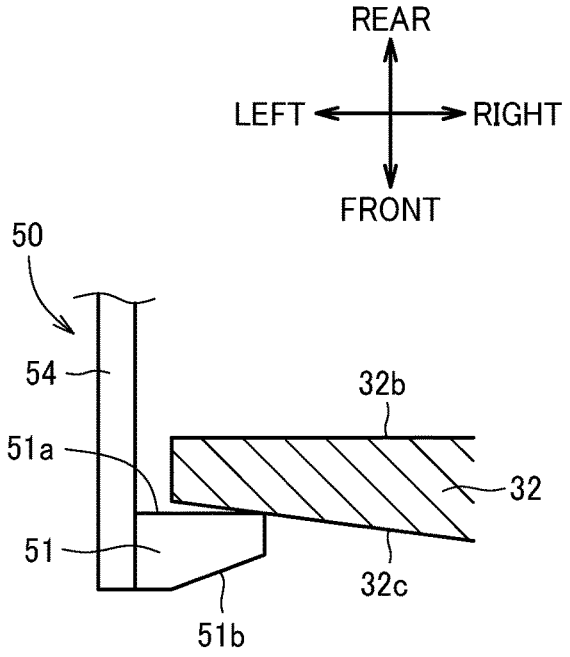
FIG. 3F is a plan view of a lock mechanism according to a second variation in a locked state.
Figure 3G:
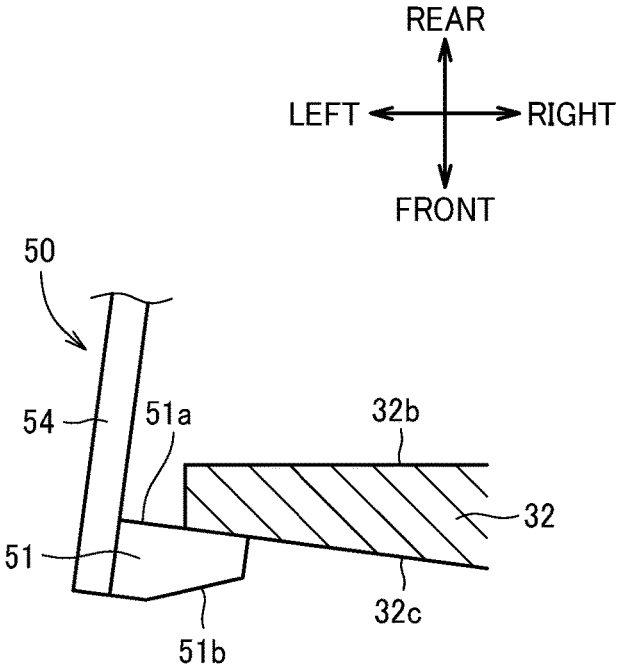
FIG. 3G is a plan view of the lock mechanism of FIG. 3F in a state immediately before locking.

FIGS. 3F and 3G illustrate a second variation in which the clearance between the access restriction cover 30 and the body of the printer 100 is reduced by the above-described taper action. The engaged portion 32 has a tapered inner surface 32*c*. In the second variation of FIGS. 3F and 3G, the effect of reducing the clearance and the effect of preventing the occurrence of abnormal noise can be obtained by the taper action similar to the taper action of FIGS. 3D and 3E.

Figure 3H:
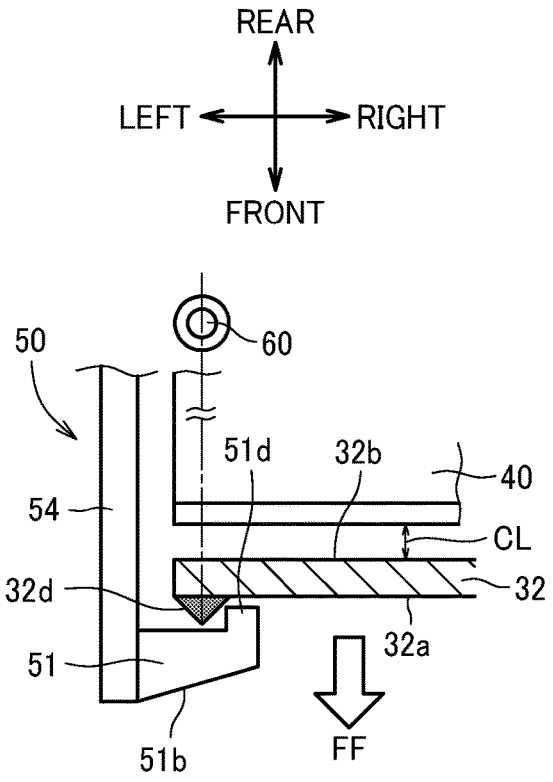
FIG. 3H is a plan view of a lock mechanism according to a third variation in a locked state.
Figure 3I:
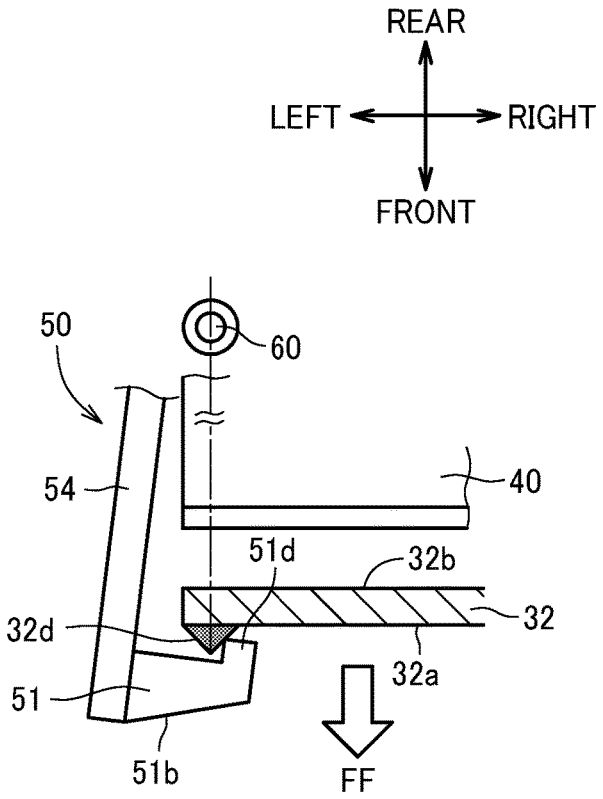
FIG. 3I is a plan view of the lock mechanism of FIG. 3H in a state immediately before locking.
Figure 3J:
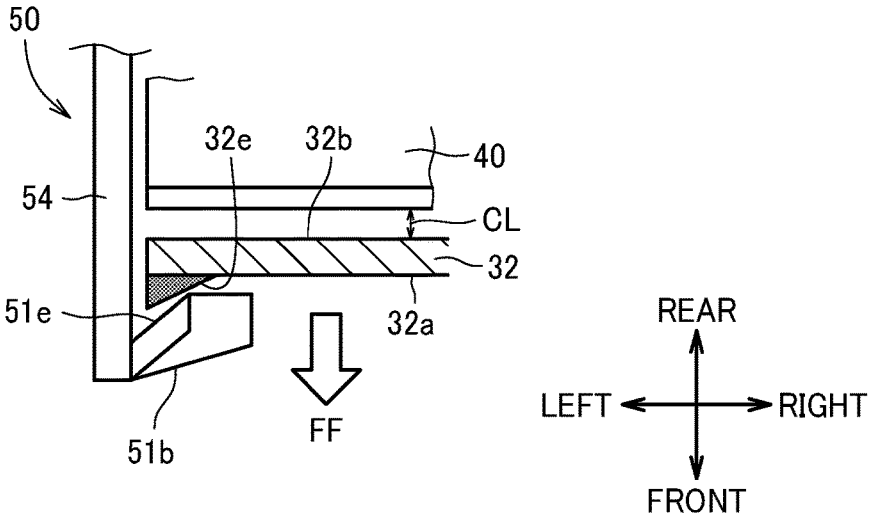
FIG. 3J is a plan view of a lock mechanism according to a fourth variation in a locked state.

FIGS. 3H and 3I and FIG. 3J are variations in which the access restriction cover 30 is not easily apparent even if a user or a service person tries to forcibly open the access restriction cover 30 by mistake. In the third variation of FIGS. 3H and 3I, a stopper portion 51*d* having an L-shape in plan view is formed at the distal end of the engaging portion 51. A stopped portion 32*d* having a triangular shape in plan view is formed on the inner surface 32*a* of the engaged portion 32 of the access restriction cover 30. The stopped portion 32*d* is placed on an extension line along the opening direction of the access restriction cover 30 passing through a support shaft 60 of the lock lever 50 as indicated by a broken line in FIGS. 3H and 3I.

When the access restriction cover 30 is closed by snap-fitting as described above and the stopper portion 51*d* rides over the stopped portion 32*d* in the right direction by the elastic restoring force of the lock lever 50 as illustrated in FIG. 3H, the locking is completed as illustrated in FIG. 3I by the momentum of the stopper portion 51*d* rides over the stopped portion 32*d*. Here, it is assumed that a user or a service person tries to forcibly open the access restriction cover 30 by mistake in a direction indicated by arrow FF from the lock completion state even though the lock of the access restriction cover 30 is not released.

In such a case, as illustrated in FIG. 3H, the stopper portion 51*d* moves to the stopped portion 32*d* due to, e.g., elastic deformation of the engaging portion 51 of the lock lever 50. However, since the stopped portion 32*d* engages with the stopper portion 51*d* when the stopper portion 51*d* further moves, the stopper portion 51*d* cannot ride over the stopped portion 32*d*, thus preventing the access restriction cover 30 from being opened. Since the force (cover opening force) for forcibly opening the access restriction cover 30 acts on the support shaft 60 of the lock lever 50 in the direction indicated by the broken line, the lock lever 50 cannot be deflected in the lock releasing direction by this force.

In the fourth variation of FIG. 3J, an inclined stopper portion 51*e* is formed instead of the stopper portion 51*d* of FIGS. 3H and 3I, and an inclined stopped portion 32*e* is formed instead of the stopped portion 32*d* of FIGS. 3H and 3I. In this variation of FIG. 3J, even if a user or a service person tries to forcibly open the access restriction cover 30 by mistake in the direction indicated by arrow FF, the inclined stopper portion 51*e* cannot move outward beyond the inclined stopped portion 32*e*.

In a case where the opening direction of the lock lever 50 is one direction in the directions orthogonal to the opening direction of the access restriction cover 30, the inclined surface of the inclined stopper portion 51*e* may be an inclined surface that is more distant from the inner surface 32*a* of the engaged portion 32 of the access restriction cover 30 in the one direction. With such an inclined surface, when a force in the opening direction is applied from the access restriction cover 30 to the inclined stopper portion 51*e* of the lock lever 50, the force (forced opening force) is converted into a biasing force that rotates the lock lever 50 about the support shaft 60 in the locking direction, and thus the lock is not released.

Note that it is not always necessary to form both the inclined stopper portion 51*e* and the inclined stopped portion 32*e*. Only one of the inclined stopper portion 51*e* and the inclined stopped portion 32*e* may be formed, and the other may be a convex portion that slides along the inclined surface of the other.

On the other hand, when the solenoid 40 applies the force for rotating the lock lever 50 about the support shaft 60 in the lock release direction in the lock release operation, the lock can be released by the stopper portions 51*d* and 51*e* riding over the inclined surfaces of the stopped portion 32*d* and the inclined stopped portion 32*e*. The access restriction cover 30 is movable in the closing direction with a play clearance (allowance for movement in the closing direction) CL of about the height of the stopped portions 32*d* and 32*e*, thus allowing the lock to be smoothly released by the play clearance.

Even if the play clearance CL exists, the access restriction cover 30 does not vibrate due to the vibration during the operation of the machine, so that an abnormal noise (chattering noise) is not generated. This is because a push button 71 of a push switch 70 is constantly in contact with the inner surface of the access restriction cover 30 to apply a biasing force in the opening direction to the access restriction cover 30.

The biasing force in the opening direction with respect to the access restriction cover 30 is only due to the elastic return force of the push button 71 and the weight of the cover described later. Accordingly, even with a light force of only the solenoid 40, the access restriction cover 30 can be smoothly unlocked by pushing the access restriction cover 30 in the closing direction within the range of the play clearance CL. Even if another load is applied to the access restriction cover 30, the lock of the access restriction cover 30 can be smoothly released by a force smaller than the force of the solenoid 40 in the lock release direction.

Position of Gravity Center of Access Restriction Cover

Figure 2B:
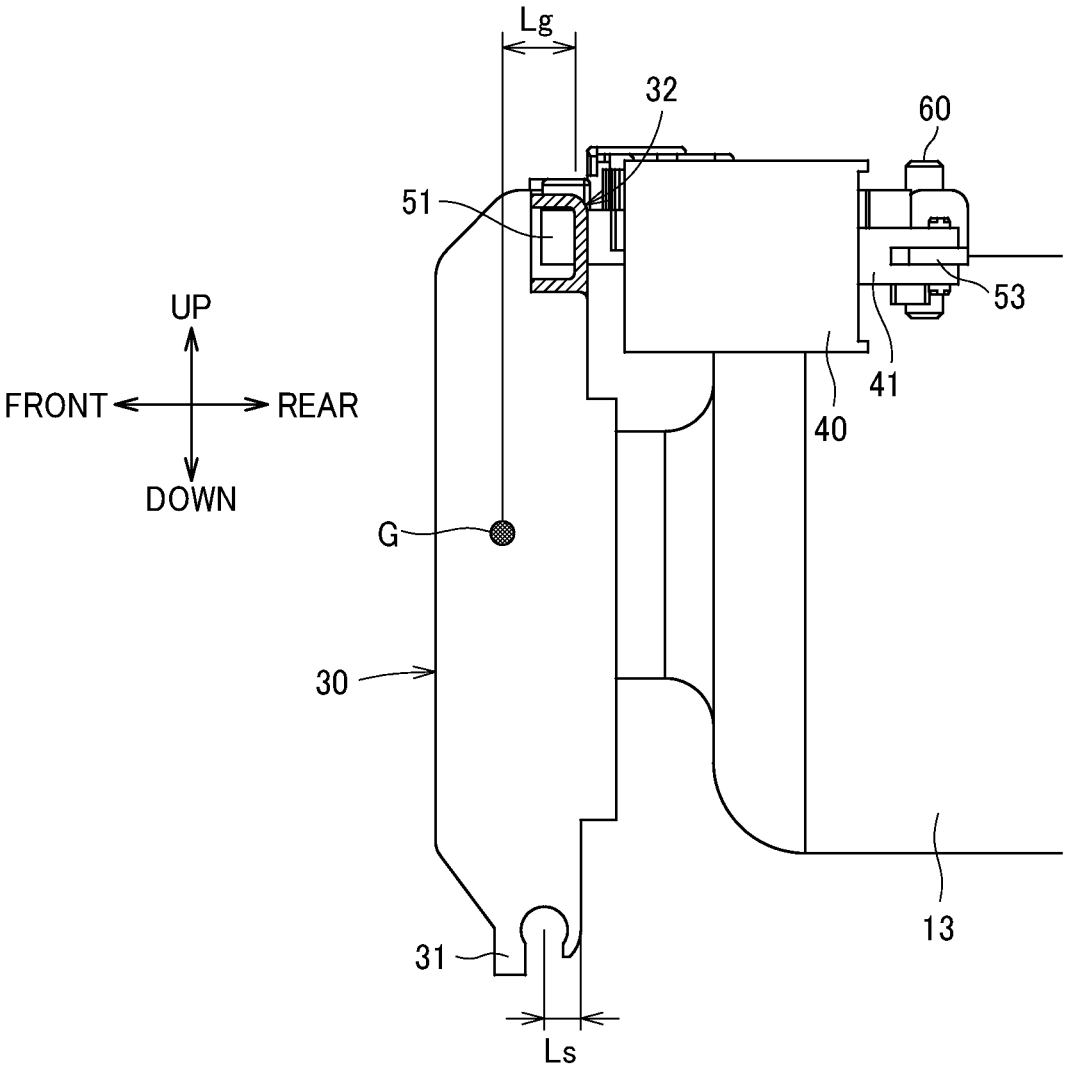
FIG. 2B is a side view of the toner bottle entrance of FIG. 2A with the access restriction cover closed.

The gravity center position G of the access restriction cover 30 is located substantially at the center in the vertical direction of the access restriction cover 30 in the closed state in FIG. 2B. The hinge portion 31 of the access restriction cover 30 is disposed at a position closer to the printer body (right side) in the horizontal direction (by a horizontal distance Ls to the printer body) than the gravity center position G.

In the closed state of the access restriction cover 30, the engaged portion 32 of the access restriction cover 30 and the engaging portion 51 of the lock lever 50 are disposed at positions above the gravity center position G in the gravity direction. The hinge portion 31 of the access restriction cover 30 is positioned in the range of a horizontal distance Lg from the gravity center position G to the inner surface 32*a* of the engaged portion 32.

In other words, the engaged portion 32 is disposed closer to the printer body by the horizontal distance Lg from the gravity center position G. The above-described arrangement of the gravity center position G of the access restriction cover 30 and the hinge portion 31 causes a counterclockwise rotational moment about the hinge portion 31 to act on the access restriction cover 30 due to the cover weight acting on the gravity center position G in the closed state of the access restriction cover 30.

This rotational moment acts in the opening direction of the access restriction cover 30. Accordingly, since the access restriction cover 30 is naturally opened by the rotational moment when the lock is released, it is not necessary to increase the load of an unlocking drive source as conventionally performed.

Push-Type Switch

Figure 2C:
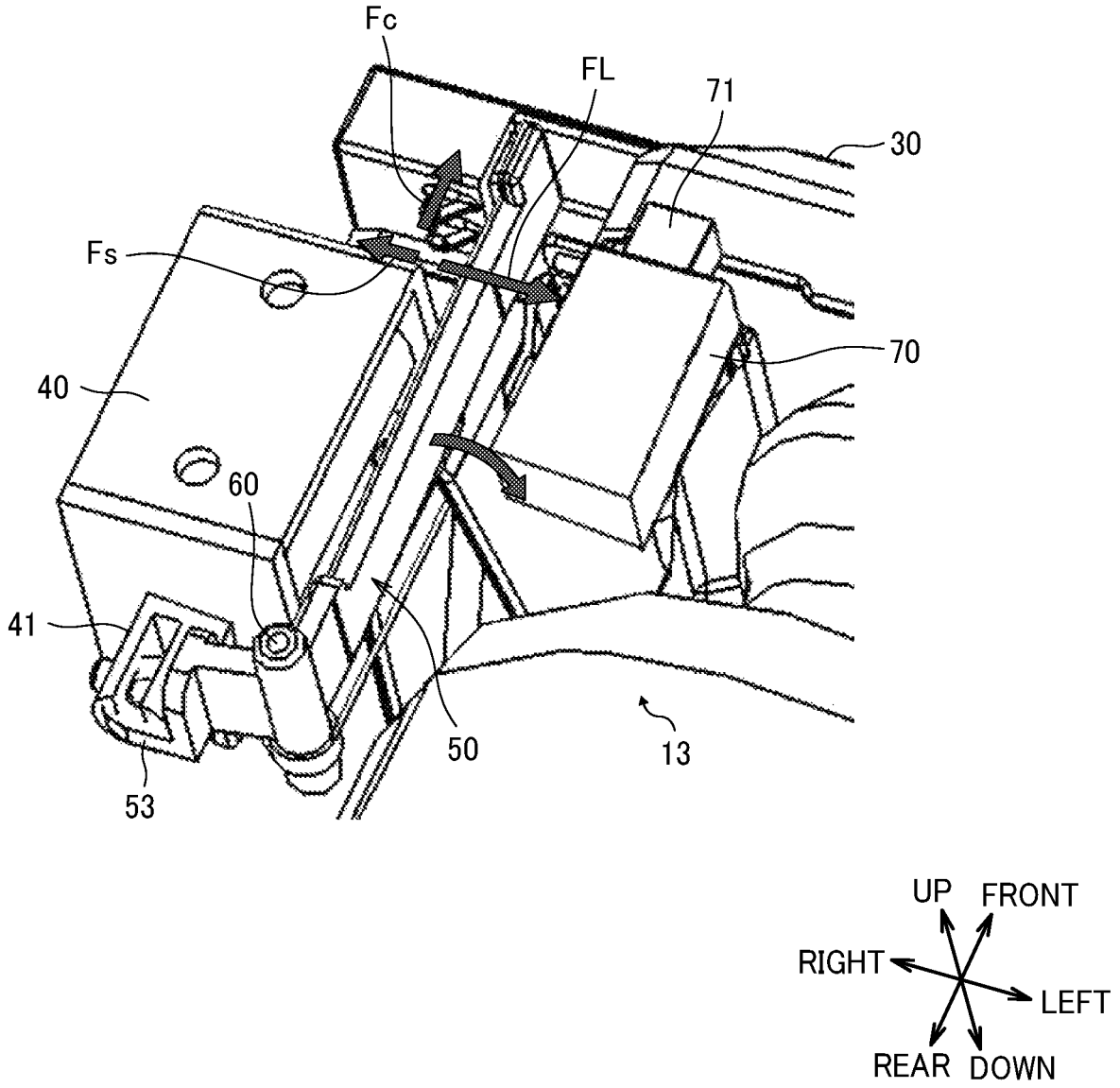
FIG. 2C is a perspective view of the toner bottle entrance with the access restriction cover closed, seen from inside.

As illustrated in FIGS. 2A and 2C, a push switch 70 serving as a detection mechanism that detects the open or closed state of the access restriction cover 30 is disposed on the opposite side of the solenoid 40 across the elastic arm portion 54. The push switch 70 has a push button 71 that elastically protrudes toward the front side (outside) in the state where the access restriction cover 30 is opened as illustrated in FIG. 2A in the upper portion of the toner bottle entrance 100*a*.

When the access restriction cover 30 is closed by snap-fitting as described above, the push button 71 is pressed by the rear edge portion of the upper end of the access restriction cover 30 as illustrated in FIG. 2C. Thus, the push switch 70 is turned off (closed-state detection). In the turned-off state, the rear edge portion of the upper end of the access restriction cover 30 is constantly pressed by the elastic return force of the push button 71. Accordingly, as soon as the engaging portion 51 of the lock lever 50 is disengaged from the engaged portion 32 of the access restriction cover 30 as illustrated in FIG. 3B, the access restriction cover 30 starts to rotate quickly in the opening direction about the hinge portion 31 due to the elastic restoring force of the push button 71 and the rotational moment caused by the weight of the cover itself.

Since the push button 71 is disposed on the opposite side of the hinge portion 31 in the vertical direction of the access restriction cover 30, the elastic restoring force of the push button 71 acts on the access restriction cover 30 as a large rotational moment in the opening direction. Accordingly, when the solenoid 40 is turned on (energized) and the engaging portion 51 of the lock lever 50 is disengaged from the engaged portion 32 of the access restriction cover 30 as illustrated in FIG. 3B, the access restriction cover 30 starts to rotate in the opening direction reliably and quickly due to the elastic restoring force of the push button 71 and the rotational moment of its own weight. On the other hand, the push switch 70 detects the open state of the access restriction cover 30 by the elastic return of the push button 71.

Forces acting on, e.g., the access restriction cover 30 and the lock lever 50 are indicated by arrows on FIG. 2C. A load acting on the access restriction cover 30 by the push button 71 is denoted by Fc, a driving force at the time of unlocking the lock lever 50 is denoted by FL, and a force of biasing the engaging portion 51 of the lock lever 50 in the engagement direction is denoted by Fs.

Since the load Fc is applied to the access restriction cover 30 in the opening direction by the push button 71, the driving force FL only needs to be large enough to disengage the engaging portion 51 of the lock lever 50 from the engaged portion 32 of the access restriction cover 30. Accordingly, the load on the solenoid 40 as an unlocking drive source can be reduced, and the solenoid 40 can be reduced in size and cost.

Variation of Hinge Portion

Figure 4B:
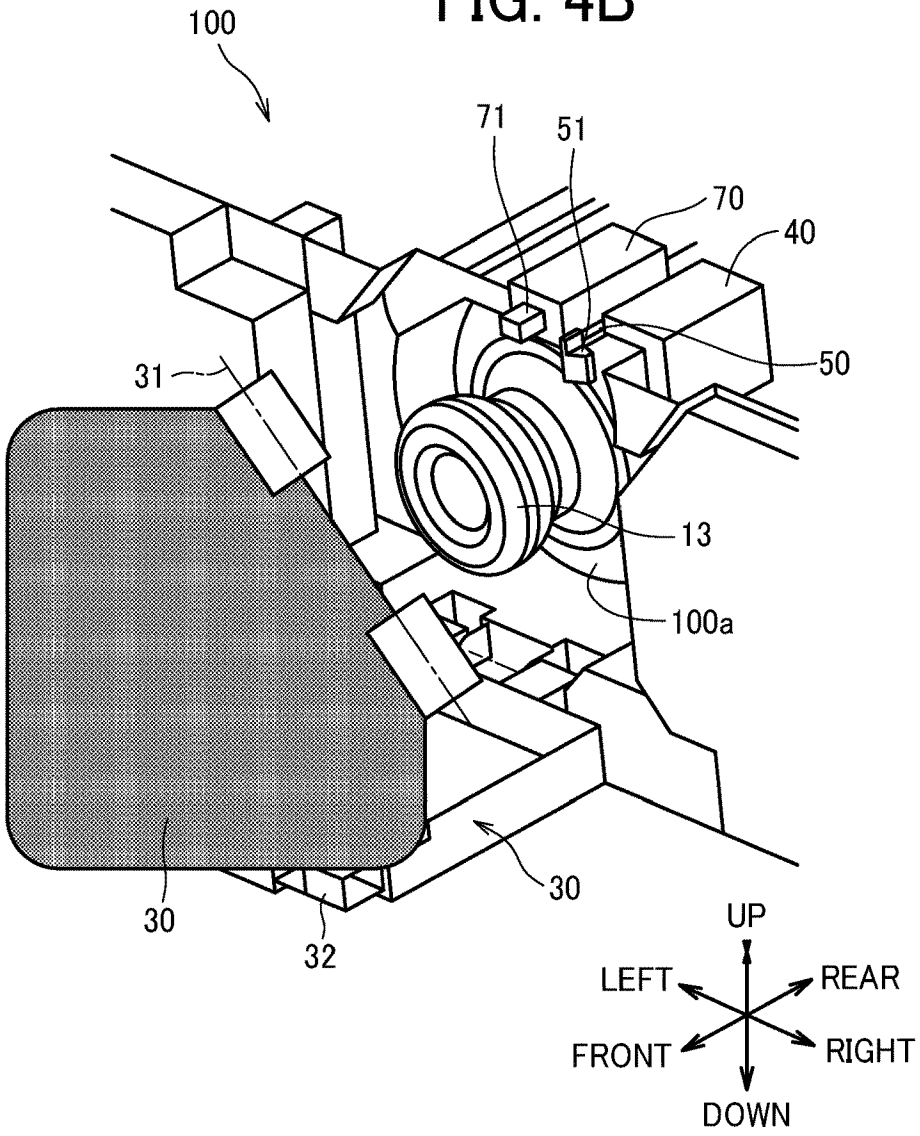
FIG. 4B is a perspective view of an inclined hinge of the access restriction cover, according to another variation.
Figure 4A:
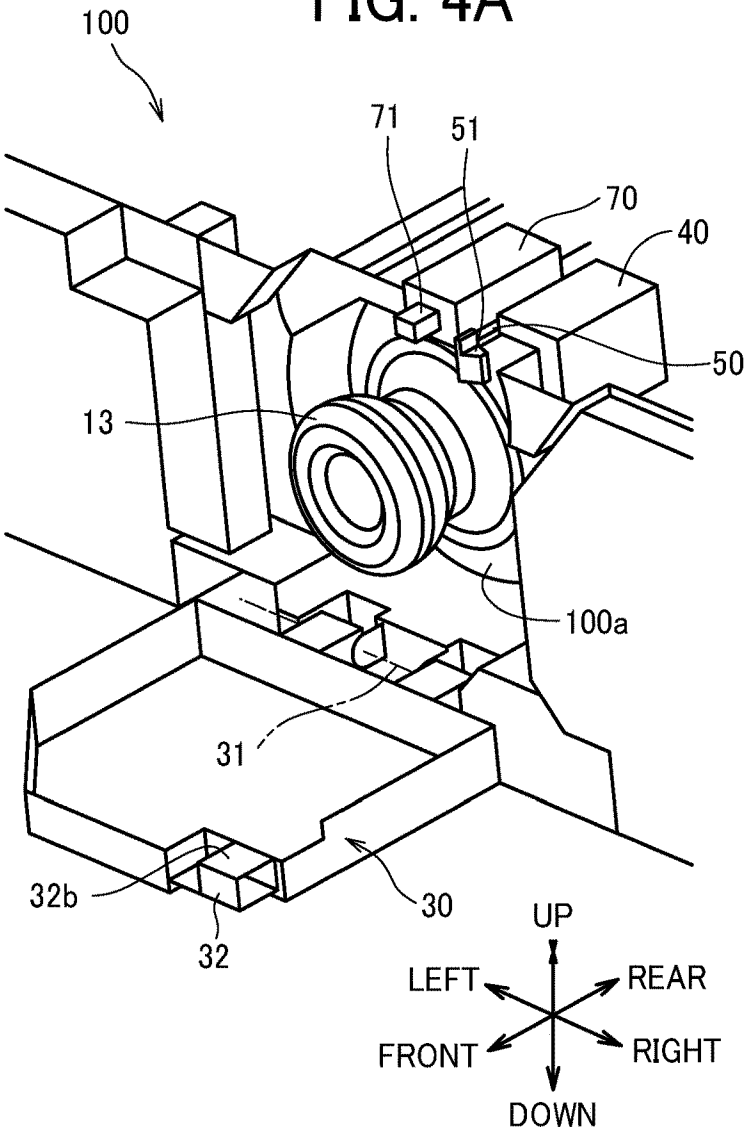
FIG. 4A is a perspective view of a horizontal hinge of the access restriction cover, according to a variation.

The hinge portion 31 may be disposed horizontally as illustrated in FIG. 4A or may be disposed obliquely as illustrated in FIG. 4B. In such a case, when the access restriction cover 30 is opened, the access restriction cover 30 is rotated obliquely downward. When the access restriction cover 30 is closed, the access restriction cover 30 is rotated obliquely upward. The shape of the access restriction cover 30 can be appropriately changed to, e.g., a triangular shape or a trapezoidal shape in accordance with the shape of the toner bottle entrance 100*a*.

Even in the case where the hinge portion 31 is disposed to be inclined, the hinge portion 31 is disposed below the center of gravity of the access restriction cover 30 in the gravity direction. Even if the toner bottle 13 falls due to its own weight and hits the access restriction cover 30 when the toner bottle 13 is pulled out, the access restriction cover 30 disposed in an inclined manner can reduce the impact on the hinge portion 31 and prevent damage to the access restriction cover 30 or the hinge portion 31.

Figure 5A:
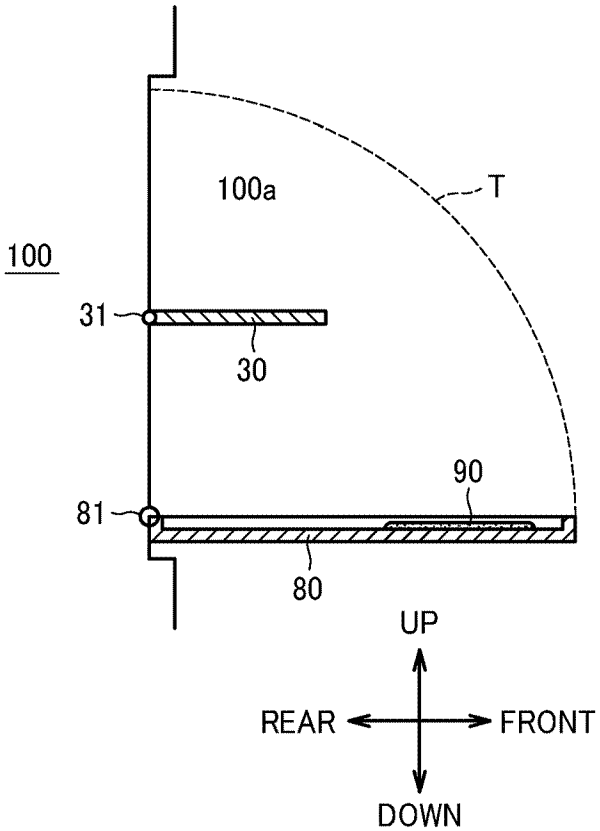
FIG. 5A is a side view of an access restriction cover and an outer cover in an open state, according to an embodiment of the present disclosure.
Figure 5B:
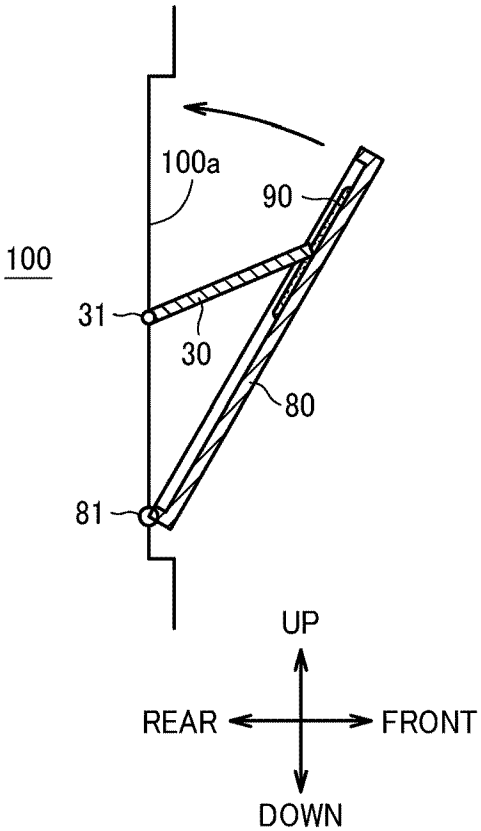
FIG. 5B is a side view of the access restriction cover and the outer cover of FIG. 5A in a half-open state.
Figure 5C:
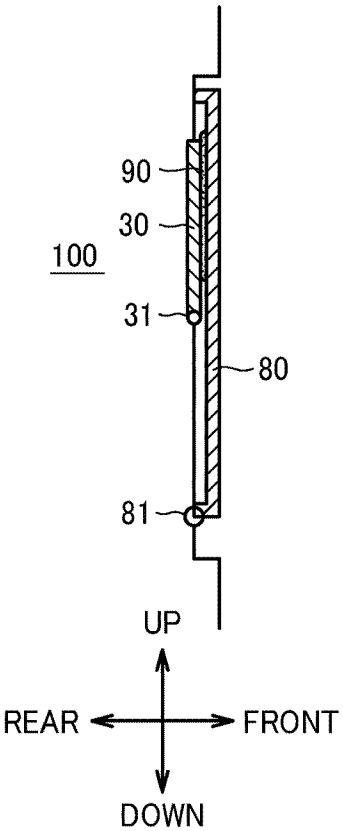
FIG. 5C is a side view of the access restriction cover and the outer cover of FIG. 5A in a closed state.

Outer Cover As illustrated in FIGS. 5A, 5B, and 5C, an outer cover 80 is attached to the side surface of the body of the printer 100 to which the access restriction cover 30 is attached. A second hinge portion 81 of the outer cover 80 is disposed below the hinge portion 31 of the access restriction cover 30 in the gravity direction. The outer cover 80 is rotatable about the second hinge portion 81 within a range of substantially 90° along a rotation path T indicated by a broken line in FIG. 5A.

When the outer cover 80 rotates from the open state illustrated in FIG. 5A to the closed state illustrated in FIG. 5C, the outer cover 80 contacts the access restriction cover 30 in the horizontally unfolded open state. Then, as illustrated in FIG. 5B, the access restriction cover 30 is pushed by the inner surface of the outer cover 80 to rotate in the closing direction. When the outer cover 80 is completely closed as illustrated in FIG. 5C, the engaged portion 32 of the access restriction cover 30 is engaged with the engaging portion 51 of the lock lever 50 by snap fit as illustrated in FIG. 3A. Thus, the access restriction cover 30 is automatically locked.

In this way, when the outer cover 80 is closed, the access restriction cover 30 is also closed together. If a new toner bottle 13 is already attached to the body of the printer 100, the toner bottle entrance 100*a* can be closed and locked by the access restriction cover 30 without touching the access restriction cover 30 with a hand.

Interlocking the access restriction cover 30 with the outer cover 80 can obviate the labor of separately closing the access restriction cover 30 and the outer cover 80. A temporary fixing mechanism that maintains the closed state by the access restriction cover 30 alone can be obviate, thus allowing advantages in terms of component layout and cost to be obtained.

Elastic Member of Outer Cover

An elastic member 90 is disposed on the inner surface of the outer cover 80. The elastic member 90 contacts a distal end portion (upper end portion) of the access restriction cover 30 when the outer cover 80 rotates from the open state to the closed state. When the outer cover 80 is rotated from the open state to the closed state, the engaged portion 32 of the access restriction cover 30 is engaged with the engaging portion 51 of the lock lever 50 by snap fit while the elastic member 90 is kept in contact with the access restriction cover 30.

When the outer cover 80 is closed, it may be practically difficult for the access restriction cover 30 to accurately come to the lock position and reliably snap-fit due to variations in, e.g., component dimensions and backlash if each cover is rigid. If the component accuracy is poor, the outer cover 80 may not be completely closed due to mutual interference between the components, or the access restriction cover 30 may not be snap-fitted even when the outer cover 80 is closed.

Even if there is some variation in component dimensions, placing the elastic member 90 between the outer cover 80 and the access restriction cover 30 allows errors such as the variations to be absorbed by the elastic member 90. Thus, the outer cover 80 and the access restriction cover 30 can be reliably closed, and the access restriction cover 30 is reliably engaged with and locked to the lock lever 50 by snap-fitting.

When the outer cover 80 is closed, the access restriction cover 30 hits the inner surface of the outer cover 80 as illustrated in FIG. 5B. However, the elastic member 90 can prevent the occurrence of collision noise at this time. Preventing direct contact between the outer cover 80 and the access restriction cover 30 can prevent a failure in which vibration of the machine (printer body) is transmitted to the outer cover 80 and noise is emitted to the machine environment.

When the solenoid 40 is automatically turned on in the toner end state and the lock lever 50 is unlocked, the access restriction cover 30 starts to open by the elastic restoring force of the push button 71 of the push switch 70 and the rotational moment due to its own weight. Accordingly, as soon as the outer cover 80 is opened, the access restriction cover 30 is automatically opened outward.

If there is no elastic member 90, the access restriction cover 30 would directly contact the inner surface of the outer cover 80 before the outer cover 80 is opened, and generate a contact sound. The elastic member 90 also has an effect of preventing such contact noise.

When the outer cover 80 is opened from the state of FIG. 5C to the state of FIG. 5A with the access restriction cover 30 being unlocked, the access restriction cover 30 is opened in conjunction with the outer cover 80 in a state in which the access restriction cover 30 leans against the outer cover 80 until the access restriction cover 30 is opened in the horizontal state. Such a configuration can obviate the need of putting a hand on the access restriction cover 30 every time, and a user or a service person can immediately start the replacement work of the toner end bottle.

Prevention of Erroneous Attachment of Toner Bottle

In the above description, the access restriction cover 30 is closed in conjunction with the closing operation of the outer cover 80 and then is engaged with and locked to the lock lever 50 by the snap fit. After the outer cover 80 is closed in conjunction with the closing operation of the outer cover 80, the access restriction cover 30 may be held in the "lockable state" by the lock lever 50 without being locked. In other words, when the outer cover 80 is closed, the engaged portion 32 of the access restriction cover 30 may be positioned to be engageable with the engaging portion 51 of the lock lever 50. This state is a state in which, in FIG. 3B, the engaged portion 32 of the access restriction cover 30 is located at the position illustrated in FIG. 3A.

When the access restriction cover 30 is immediately locked together with the closing operation of the outer cover 80, the printer 100 is immediately ready for operation (printing). However, there is a possibility that the toner bottle 13 that a user or a service person thinks has been replaced remains as an old toner bottle or is a toner bottle of a different color or a different model (possibility of erroneous attachment).

For this reason, before the access restriction cover 30 is locked, the presence or absence and the appropriateness of the toner bottle 13 are detected from, e.g., integrated circuit (IC) chip data of the toner bottle 13 attached to the body of the printer 100. A reader such as a near field communication (NFC) reader is disposed inside the toner bottle entrance 100*a*, and the IC chip data of the toner bottle 13 mounted on the body of the printer 100 is automatically read by the reader. Based on the read data, a controller of the printer 100 determines whether the toner bottle 13 is appropriate.

If there is no problem with the toner bottle 13, the solenoid 40 is energized (turned on), and the engaging portion 51 of the lock lever 50 is engaged with the engaged portion 32 of the access restriction cover 30 as illustrated in FIG. 3A. If there is a problem with the toner bottle 13, the access restriction cover 30 is not locked, and this fact is displayed on the operation unit 6 (see FIG. 1B) of the printer 100. The user or the service person can surely know the erroneous attachment of the toner bottle 13 by the display, and can quickly perform the inspection work of the toner bottle 13.

Although several embodiments of the present disclosure have been described above, embodiments of the present disclosure are not limited to the embodiments described above, and a variety of modifications can naturally be made within the scope of the present disclosure. For example, in the above-described embodiments, the access restriction device is for a toner bottle as a consumable component. However, in some embodiments of the present disclosure, an access restriction device may be for any consumable component other than the toner bottle. For example, in some embodiments of the present disclosure, an access restriction device may be for an ink cartridge of an inkjet printer or an access restriction device may be for an oil bottle containing a release agent for a pressure roller of a fixing device.

Some embodiments of the present disclosure have been described in detail above. Numerous additional modifications to the above-described embodiment and variations are possible. It is therefore to be understood that, within the scope of the appended claims, the disclosure of this patent specification may be practiced otherwise than as specifically described herein. For example, embodiments and advantageous configurations may be combined with each other.

The invention claimed is:

1. An access restriction device for a consumable component of an apparatus body, the access restriction device comprising:

an access restriction cover rotatably attached to a side surface of the apparatus body;

a lock configured to lock and unlock opening of the access restriction cover, the access restriction cover being openable in an unlocked state of the lock;

a hinge portion disposed at a lower position in a direction of gravity and a position closer to the apparatus body in a horizontal direction than a center of gravity of the access restriction cover in a closed state of the access restriction cover, the access restriction cover being rotatably coupled to the apparatus body via the hinge portion; and an engaged portion disposed at a position higher in the direction of gravity than the center of gravity of the access restriction cover in the closed state of the access restriction cover, the access restriction cover being configured to engaged with an engaging portion of the lock via the engaged portion, wherein the entire engaged portion is disposed at a position closer to the apparatus body in the horizontal direction than the center of gravity of the access restriction cover in the closed state of the access restriction cover.

2. The access restriction device according to claim 1, wherein the lock is disposed on an opposite side of the hinge portion in the direction of gravity across the center of gravity of the access restriction cover in the closed state of the access restriction cover.

3. The access restriction device according to claim 2, further comprising a detector configured to detect an open state and a closed state of the access restriction cover, wherein the detector is disposed in vicinity of the lock.

4. The access restriction device according to claim 3, wherein the detector includes a push switch configured to press against the access restriction cover in the closed state of the access restriction cover and release pressing against the access restriction cover in the open state of the access restriction cover.

5. The access restriction device according to claim 4, wherein the push switch is configured to press an upper end of the access restriction cover in an opening direction in the closed state of the access restriction cover.

6. The access restriction device according to claim 1, further comprising another hinge portion disposed below the hinge portion of the access restriction cover in the direction of gravity; and an outer cover rotatable about said another hinge portion, wherein the engaged portion of the access restriction cover is configured to be at a position at which the engaged portion is engageable with the engaging portion of the lock, when the outer cover is closed.

7. The access restriction device according to claim 6, wherein when the outer cover rotates from an open state to the closed state, the outer cover is configured to abut against the access restriction cover in the open state to rotate the access restriction cover in a closing direction, and the engaged portion is engaged with the engaging portion of the lock to lock the opening of the access restriction cover.

8. The access restriction device according to claim 7, further comprising an elastic supporter disposed on an inner surface of the outer cover, wherein the elastic supporter is configured to abut against the access restriction cover when the outer cover rotates from the open state to the closed state.

9. The access restriction device according to claim 8, wherein the engaged portion of the access restriction cover is configured to, in response to a rotation of the outer cover from the open state to the closed state, be engaged with the engaging portion of the lock while the elastic supporter is kept in contact with the access restriction cover.

10. The access restriction device according to claim 1, wherein the engaging portion of the lock or the engaged portion of the access restriction cover includes a tapered portion, and wherein the access restriction cover is configured to be pulled toward the apparatus body by a tapering action of the tapered portion in response to a locking operation of the lock.

11. The access restriction device according to claim 1, wherein when a cover opening force in an opening direction acts on the access restriction cover in a locked state of the lock, a stopped portion on the engaged portion of the access restriction cover is configured to engage with a stopper portion on the engaging portion of the lock.

12. The access restriction device according to claim 1, wherein when a cover opening force in an opening direction acts on the access restriction cover in a locked state of the lock, a stopped portion on the engaged portion of the access restriction cover is configured to slide on a stopper portion on the engaging portion of the lock by the cover opening force, to bias the lock in a locking direction.

13. An image forming apparatus comprising:

an apparatus body to which a toner bottle as a consumable component is attached; and the access restriction device according to claim 1 attached to an entrance of the apparatus body through which the toner bottle is inserted and removed.

14. The access restriction device according to claim 1, wherein the hinge portion is disposed at the position between the center of gravity of the access restriction cover and the engaged portion in the horizontal direction in the closed state of the access restriction cover.

* * * * *